US010231498B2

(12) United States Patent
Kwon

(10) Patent No.: US 10,231,498 B2
(45) Date of Patent: Mar. 19, 2019

(54) PATCH FOR SPORTSWEAR AND METHOD FOR PRODUCING THE SAME

(71) Applicant: Hui Su Kwon, Seoul (KR)

(72) Inventor: Hui Su Kwon, Seoul (KR)

( * ) Notice: Subject to any disclaimer, the term of this patent is extended or adjusted under 35 U.S.C. 154(b) by 482 days.

(21) Appl. No.: 14/942,885

(22) Filed: Nov. 16, 2015

(65) Prior Publication Data

US 2016/0174638 A1 Jun. 23, 2016

(30) Foreign Application Priority Data

Nov. 17, 2014 (KR) ..... 10-2014-0160049

(51) Int. Cl.
*A41D 27/08* (2006.01)

(52) U.S. Cl.
CPC ..... *A41D 27/08* (2013.01)

(58) Field of Classification Search
None
See application file for complete search history.

(56) References Cited

U.S. PATENT DOCUMENTS 2,062,336 A * 12/1936 Sexton ..... D06C 23/00 428/481
3,657,060 A * 4/1972 Haigh ..... B44F 11/00 139/426 R
5,009,943 A * 4/1991 Stahl ..... B32B 27/12 428/40.6
5,635,001 A * 6/1997 Mahn, Jr. ..... A41D 27/08 156/93
5,817,393 A * 10/1998 Stahl ..... B32B 5/26 428/104
2005/0100689 A1* 5/2005 He ..... B32B 27/00 428/32.79
2006/0135013 A1* 6/2006 Higashiguchi ..... B32B 5/022 442/150
2006/0183852 A1* 8/2006 Liu ..... B32B 27/12 524/591
2009/0280290 A1* 11/2009 Weedlun ..... D06P 5/12 428/102
2011/0223373 A1* 9/2011 Abrams ..... D06Q 1/14 428/90
2012/0141698 A1* 6/2012 Oleary ..... D06P 5/003 428/32.77
2012/0263905 A1* 10/2012 Park ..... G09F 3/10 428/41.8

FOREIGN PATENT DOCUMENTS

KR 20080070616 A * 7/2008
KR 101109037 B1 * 1/2012

OTHER PUBLICATIONS

Yoo, Chang Soon, "Embossing decoration and manufacturing method and dives", English translation of KR101109037 B1, published Jan. 31, 2012 (Year: 2012).*
Choi Nak Jong, "Adhesive sheet for cloths", English translation of KR20080070616A, published Jul. 30, 2008 (Year: 2008).*

* cited by examiner

*Primary Examiner* — Anish P Desai
(74) *Attorney, Agent, or Firm* — STIP Law Group, LLC

(57) ABSTRACT

Disclosed are a patch for sportswear, which is fixed on the surface of a T-shirt or team uniform, and a method of producing the same, wherein the patch includes a substrate layer, including a polyester fabric layer having a pattern, a colorless polyurethane base coating layer, and first, second and third polyurethane-mixed coating layers, which are sequentially formed; an anti-migration shielding layer, including a hot-melt adhesive sheet layer, a first primer coating layer, a first barrier coating layer, a second barrier coating layer and a second primer coating layer; and a double-sided adhesive layer for bonding the substrate layer and the shielding layer to each other, whereby the patch can be simply fixed on a finished sportswear product, does not migrate over time, and is not stripped even after washing at least 50 times, thus exhibiting high durability, and whereby environmentally friendly production of the patch is possible.

6 Claims, 2 Drawing Sheets

PATCH FOR SPORTSWEAR AND METHOD FOR PRODUCING THE SAME

The present application claims the priority benefit of Korean Application No. 10-2014-0160049 filed Nov. 17, 2014, which is hereby incorporated by reference.

BACKGROUND OF THE INVENTION

1. Field of the Invention

The present invention relates to a patch for sportswear and a method for producing the same and, more particularly, to a patch for sportswear and a method of manufacturing the same, in which the patch may be easily applied to finished sportswear products such as T-shirts, team uniforms, etc., and may be produced in an environmentally friendly manner without pollution.

2. Description of the Related Art

In the field of sportswear products, such as T-shirts, team uniforms, etc., patches having variously shaped figures or letters depending on the trade names of manufacturers and the demand of consumers are separately manufactured to impart decorative effects and clearly show the team names of athletic teams, and are then fixed to the front and rear sides of sportswear through sewing or using a binder in the sewing process.

Generally, a patch for sportswear is produced in a manner in which a binder is applied on fabrics of various materials, a pattern sheet having a desired figure or letter is positioned thereon, pressing and binding are performed to form a laminate, and the laminate is cut, after which the resulting patch is fixed through binding using a binder or embroidery processing in the sewing process for the production of sportswear. The patch for sportswear having a laminated structure is advantageous because the pattern, such as a figure or letter, has a three-dimensional appearance, and is thus visually prominent and conveys an impression of authenticity.

However, in the case where such a patch is bound using a binder to sportswear, especially sportswear in mesh form having therein rectangular or oval small holes for increasing air and moisture permeability, the binding process is very difficult, and the patch may be removed due to frequent washing, undesirably decreasing color fastness to washing. Furthermore, in the case where the patch is fixed through a sewing process such as embroidery processing, the patch is embroidered at a desired position on the sportswear upon sewing the sportswear, resulting in complicated patch fixing processing. Moreover, the patch, which has been fixed to sportswear, is problematic because migration, in which the pigment or dye applied to a sportswear product migrates onto the pattern of the patch, may occur over time, undesirably deteriorating the quality of the product.

Accordingly, a variety of methods are being developed to produce a patch for sportswear, which may impart a three-dimensional appearance, is not susceptible to migration, and enables easy production and high production efficiency.

CITATION LIST

Patent Literature (Patent Document 1) Korean Patent No. 10-1109037 (Registration Date: Jan. 17, 2012)

(Patent Document 2) Korean Patent Application Publication No. 2008-0070616 (Laid-open Date: Jul. 30, 2008)

SUMMARY OF THE INVENTION

Intensive and thorough research into patches for sportswear, carried out by the present inventors aiming to solve the problems encountered in the related art, has led to development of a method of producing a patch for sportswear, in which the patch may be easily fixed to finished sportswear products, thus reducing the production cost thereof, and the patch may be simply applied to sportswear in response to an order or sale thereof, thus decreasing the burden of carrying inventory, and furthermore, the patch may be produced in an environmentally friendly manner without the use of environmental pollutants, and the fixed patch is not susceptible to migration even after the lapse of a long period of time.

Therefore, the present invention is intended to provide a patch for sportswear and a method of producing the same, in which a special shielding layer is provided on the substrate layer of a patch for sportswear in laminate form, whereby the patch may be easily fixed to finished sportswear products, and no migration occurs even in a bonding process at high temperature under high pressure or while wearing, and the patch is not stripped even after washing at least 50 times, thus exhibiting high durability, and furthermore, the production process is environmentally friendly without any pollution.

The present invention provides a patch for sportswear, comprising:

a substrate layer, including:

a polyester fabric layer having a pattern having an arbitrary shape, such as a letter or number, on the surface thereof, a polyurethane base coating layer adhered to the polyester fabric layer, a first polyurethane-mixed coating layer adhered to the polyurethane base coating layer and formed of a mixture solution comprising a polyurethane base solution and a white pigment, a second polyurethane-mixed coating layer adhered to the first polyurethane-mixed coating layer, and a third polyurethane-mixed coating layer adhered to the second polyurethane-mixed coating layer;

an anti-migration shielding layer, including:

a hot-melt adhesive sheet layer, a first primer coating layer for enhancing adhesion between the hot-melt adhesive sheet layer and a first barrier coating layer, the first barrier coating layer for preventing the color of a dye or a pigment from migration from sportswear, a second barrier coating layer adhered to the first barrier coating layer, and a second primer coating layer adhered to the second barrier coating layer; and a double-sided adhesive layer for bonding the third polyurethane-mixed coating layer of the substrate layer and the second primer coating layer of the shielding layer to each other.

In the substrate layer of the patch for sportswear according to the present invention, the polyurethane base coating layer is formed by applying a polyurethane base solution comprising a polyurethane resin, methyl ethyl ketone (MEK) and cyclohexane, and the polyurethane base solution is obtained by mixing a polyurethane resin, MEK and cyclohexane at a weight ratio of 4~5:3~4:1~2 in order to maintain the overall flatness of the substrate layer and to enhance the adhesion of the polyester fabric layer to the first polyurethane-mixed coating layer formed thereon. If the polyurethane resin, which is responsible for maintaining the flatness of the polyurethane base coating layer, is used in an amount less than the lower limit, it is difficult to maintain the flatness of the substrate layer. In contrast, if the polyurethane resin is used in an amount that exceeds the upper limit, the substrate layer becomes too thick. Hence, when these components are mixed in the above ranges, the resulting coating solution enables the viscosity to be maintained constant throughout the processing time without drying during the coating process, while mutually complementing the sublimation conditions of MEK and cyclohexane.

In the anti-migration shielding layer, the first and second barrier coating layers are individually formed by applying a mixture solution comprising nitrocellulose, calcium carbonate, a polyurethane resin, MEK and cyclohexane. The mixture solution is preferably composed of nitrocellulose, calcium carbonate, a polyurethane resin, MEK, and cyclohexane, mixed at a weight ratio of 4~5:1:3~4:8:2, in order to effectively block the pigment or dye from diffusing in a vapor phase from sportswear and to adjust the viscosity of the coating solution. Here, nitrocellulose is mixed with calcium carbonate to form a film having a predetermined thickness, thereby blocking the color of the pigment or dye from migration in a vapor phase from the sportswear. If nitrocellulose is used in an amount less than the lower limit, the film is too thin and the blocking function thereof is insignificant. In contrast, if nitrocellulose is used in an amount that exceeds the upper limit, adhesion may decrease. The polyurethane resin is appropriately mixed in the above range to maintain the flatness of the first and second barrier coating layers while imparting elasticity and adhesion thereto. Also, MEK and cyclohexane are used at the prescribed ratio to impart adhesion and to maintain appropriate viscosity through complementary interactions when applied.

In addition, the present invention provides a method of producing a patch for sportswear, comprising:

forming a substrate layer, comprising a polyester fabric layer, a colorless polyurethane base coating layer applied on the polyester fabric layer, a first polyurethane-mixed coating layer formed by applying a mixture solution comprising a polyurethane base solution and a white pigment on the polyurethane base coating layer, a second polyurethane-mixed coating layer applied on the first polyurethane-mixed coating layer, and a third polyurethane-mixed coating layer applied on the second polyurethane-mixed coating layer;

forming an anti-migration shielding layer, comprising a hot-melt adhesive sheet layer, a first primer coating layer for enhancing adhesion between the hot-melt adhesive sheet layer and a first barrier coating layer, the first barrier coating layer for preventing the color of a dye and a pigment from migration from sportswear, a second barrier coating layer applied on the first barrier coating layer, and a second primer coating layer applied on the second barrier coating layer;

forming a pattern, by placing a pattern sheet on the polyester fabric layer of the substrate layer and performing sublimation transfer through pressing at 180 to 210° C. for 20 to 35 sec, thus transferring the pattern such as a letter or number;

laminating the substrate layer and the shielding layer, by positioning a double-sided adhesive layer on the third polyurethane-mixed coating layer of the substrate layer, positioning the second primer coating layer of the shielding layer on the double-sided adhesive layer under which the substrate is positioned, and performing roller pressing at 120 to 155° C. for 3 to 5 sec, thus bonding the substrate layer and the shielding layer to each other to form a laminate; and cutting the laminate comprising the substrate layer and the shielding layer along the pattern of the polyester fabric layer of the substrate layer using a laser cutter, thereby forming a patch.

If the forming the pattern is performed under conditions of a temperature lower than 180° C. and a pressing time shorter than 20 sec, the polyester fabric layer may not be dyed well with the pattern. On the other hand, if this process is performed under conditions of a temperature higher than 210° C. and a pressing time longer than 35 sec, the fabric may be damaged. Hence, the sublimation transfer treatment is preferably carried out within the prescribed temperature and time ranges.

If the laminating the substrate layer and the shielding layer is performed under conditions of a temperature lower than 120° C. and a pressing time shorter than 3 sec, the substrate layer and the shielding layer may be separated from each other. On the other hand, if this process is performed under conditions of a temperature higher than 155° C. and a period of time longer than 5 sec, the first and second barrier coating layers of the shielding layer may deteriorate or break. Hence, the lamination process has to be carried out within the prescribed temperature and time ranges.

In a patch for sportswear and a method of producing the same according to the present invention, a special shielding layer is provided between a sportswear product and a substrate layer having a predetermined pattern, and thus no migration occurs even after the lapse of a long period of time. Furthermore, the patch can be easily fixed to a finished sportswear product, and cannot be stripped even upon frequent washing, thus exhibiting high durability.

When the patch is produced or fixed to sportswear, binders, such as a polyvinyl chloride (PVC) resin and the like, which generate environmental hormones, and other harmful materials, are not used, thus enabling the environmentally friendly production of the patch for sportswear without pollution. Furthermore, the patch can be simply fixed to sportswear through a sewing process such as embroidery processing in response to orders, and there is thus no economic burden related to carrying inventory.

BRIEF DESCRIPTION OF THE DRAWINGS

The above and other objects, features and advantages of the present invention, regarding a patch for sportswear and a method of producing the same according to the present invention, will be more clearly understood from the following detailed description taken in conjunction with the accompanying drawings, in which.

DESCRIPTION OF THE PREFERRED EMBODIMENTS

Figure 1:
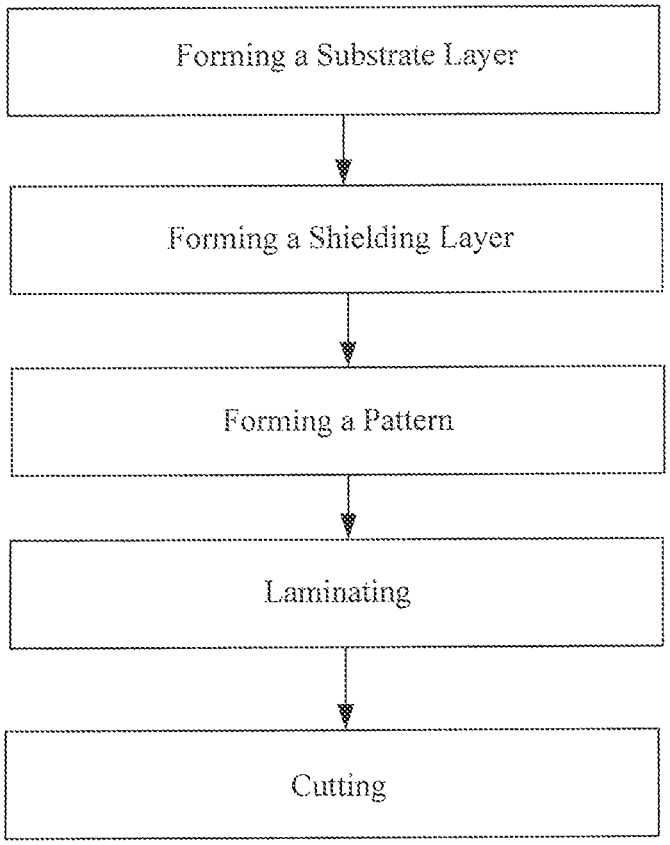
FIG. 1 is a flowchart illustrating the process of producing a patch for sportswear according to the present invention.
Figure 2:
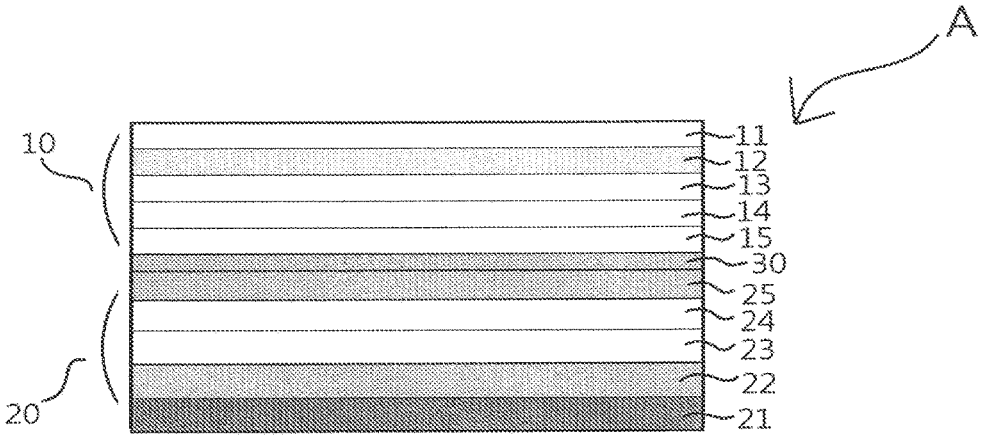
FIG. 2 is a cross-sectional view illustrating the patch for sportswear according to the present invention.

FIG. 1 is a flowchart sequentially illustrating the process of producing a patch for sportswear according to the present invention, and FIG. 2 is a cross-sectional view illustrating the patch for sportswear according to the present invention.

As illustrated in FIG. 2, the patch A for sportswear according to the present invention comprises:

a substrate layer 10, including a polyester fabric layer 11 having an arbitrary pattern, such as a letter or a number, on the surface thereof, a colorless polyurethane base coating layer 12 adhered to the polyester fabric layer 11, a first polyurethane-mixed coating layer 13 formed of a mixture comprising a polyurethane base solution and a white pigment and adhered to the polyurethane base coating layer 12, a second polyurethane-mixed coating layer 14 adhered to the first polyurethane-mixed coating layer 13, and a third polyurethane-mixed coating layer 15 adhered to the second polyurethane-mixed coating layer 14, an anti-migration shielding layer 20, including a hot-melt adhesive sheet layer 21, a first primer coating layer 22 formed by applying a mixture solution comprising nitrocellulose and a polyurethane resin at the same weight ratio to increase adhesion between the hot-melt adhesive sheet layer 21 and a first barrier coating layer 23, the first barrier coating layer 23 for preventing the color of a dye and a pigment from migration from sportswear, a second barrier coating layer 24 applied on the first barrier coating layer 23, and a second primer coating layer 25 formed by applying the same mixture solution as in the first primer coating layer 22 on the second barrier coating layer 24, and a double-sided adhesive layer 30 for bonding the third polyurethane-mixed coating layer 15 of the substrate layer 10 and the second primer coating layer 25 of the shielding layer 20 to each other.

In the patch A for sportswear according to the present invention, the polyester fabric layer 11 is provided with various patterns, such as letters or numbers, on the surface thereof through subsequent pattern-forming processing, and is a white polyester fabric including a woven fabric or a knitted fabric.

The colorless polyurethane base coating layer 12, which is adhered to the polyester fabric layer 11, is formed by applying a polyurethane base solution comprising a polyurethane resin, MEK and cyclohexane, mixed at a weight ratio of 4~5:3~4:1~2, and functions to maintain the flatness of the substrate layer 10 in laminate form and to improve bondability between the polyester fabric layer 11 and the first polyurethane-mixed coating layer 13.

In the substrate layer 10, the first polyurethane-mixed coating layer 13 is formed by applying, on the polyurethane base coating layer 12, a mixture comprising the same polyurethane base solution as in the polyurethane base coating layer 12 and a white pigment mixed at a weight ratio of 4:1, and additionally, the second polyurethane-mixed coating layer 14 and the third polyurethane-mixed coating layer 15 are formed in the same manner as in the first polyurethane-mixed coating layer 13, by sequentially applying the corresponding mixture two times on the first polyurethane-mixed coating layer 13. The substrate layer 10 is responsible for thoroughly preventing migration together with the shielding layer 20 located thereunder while imparting elasticity to the patch for sportswear by means of the first, second and third polyurethane-mixed coating layers 13, 14, 15.

The anti-migration shielding layer 20, which is prepared separately from the substrate layer 10, is configured to include, on the hot-melt adhesive sheet layer 21 having a release sheet attached thereto, the first primer coating layer 22 for increasing adhesion to the first barrier coating layer 23, the first barrier coating layer 23 for preventing the color of the dye and pigment from migration from the sportswear, the second barrier coating layer 24 applied on the first barrier coating layer 23, and the second primer coating layer 25 applied on the second barrier coating layer 24.

The first primer coating layer 22 is formed by applying a primer coating solution comprising nitrocellulose and polyurethane resin mixed in the same amount, and a mixture solution comprising nitrocellulose, calcium carbonate, polyurethane resin, MEK and cyclohexane at a weight ratio of 4~5:1:3~4:8:2 is sequentially applied two times on the first primer coating layer 22, thus forming the first and second barrier coating layers 23, 24. Thereby, the pigment or dye may be effectively prevented from diffusing in a vapor phase from sportswear, and flatness may be maintained without warping upon drying the shielding layer 20.

On the second barrier coating layer 24, the second primer coating layer 25 is formed using the same coating solution as in the first primer coating layer 22, whereby the complete bonding of the shielding layer 20, including the second barrier coating layer 24, may be firmly ensured.

The substrate layer 10 and the shielding layer 20 are integrally laminated by means of the double-sided adhesive layer 30 for bonding the third polyurethane-mixed coating layer 15 of the substrate layer 10 and the second primer coating layer 25 of the shielding layer 20 to each other, yielding a patch for sportswear as illustrated in FIG. 2.

The patch for sportswear according to the present invention is produced through, as illustrated in FIG. 1, formation of a substrate layer 10 (S1), formation of a shielding layer 20 (S2), formation of a pattern (S3), lamination (S4), and cutting (S5) for forming a laminate into a patch.

Formation of Substrate Layer 10 (S1)

In the step of forming the substrate layer 10, a polyester fabric layer 11 is placed on a work table, a polyurethane base solution comprising a polyurethane resin, MEK and cyclohexane mixed at a weight ratio of 4~5:3~4:1~2 is applied on the polyester fabric layer 11 to thus form a polyurethane base coating layer 12, and a polyurethane-mixed coating solution comprising the polyurethane base solution and a white pigment at a weight ratio of 4:1 is sequentially applied three times on the polyurethane base coating layer 12 to provide a white thin-film layer while appropriately imparting elastic force and adhesion, thus forming a first polyurethane-mixed coating layer 13, a second polyurethane-mixed coating layer 14 and a third polyurethane-mixed coating layer 15, resulting in a substrate layer 10.

Formation of Anti-Migration Shielding Layer 20 (S2)

In the step of forming the anti-migration shielding layer 20, a primer coating solution comprising nitrocellulose and a polyurethane resin mixed at the same weight ratio is applied on a hot-melt adhesive sheet layer 21, thus forming a first primer coating layer 22, and a mixture solution comprising nitrocellulose, calcium carbonate, a polyurethane resin, MEK and cyclohexane at a weight ratio of 4~5:1:3~4:8:2 is sequentially applied two times on the first primer coating layer 22, yielding first and second barrier coating layers 23, 24, which function to effectively prevent the pigment or dye from diffusing in a vapor phase from sportswear, after which the same primer coating solution as in the first primer coating layer 22 is applied on the second barrier coating layer 24 to thereby form a second primer coating layer 25, resulting in a shielding layer 20.

Formation of Pattern (S3)

In the step of forming the pattern, a pattern sheet is placed on the polyester fabric layer 11 of the substrate layer 10 and is then subjected to a sublimation transfer process through pressing at 180 to 210° C. for 20 to 35 sec, thus transferring the pattern, such as a letter or number. Here, the dye that is used may be a dispersion dye having high sublimation performance, so that the pattern is printed from the transfer sheet to the fiber through sublimation transfer of the dispersion dye using a hot press, whereby a variety of desired patterns, such as letters or numbers, are formed on the surface of the polyester fabric layer 11.

Lamination (S4)

In the step of laminating the layers, a double-sided adhesive layer 30 is positioned on the third polyurethane-mixed coating layer 15 of the substrate layer 10, the polyester fabric layer 11 of the substrate layer 10 is disposed to face downwards, and the second primer coating layer 25 of the shielding layer 20 is positioned on the double-sided adhesive layer 30, followed by roller pressing at 120 to 155° C. for 3 to 5 sec, thereby bonding the substrate layer 10 and the shielding layer 20 to each other to form a laminate.

Cutting (S5)

In the cutting step, the laminate, comprising the substrate layer 10 and the shielding layer 20, resulting from the lamination step, is cut along the pattern that has been transferred onto the polyester fabric layer 11 of the substrate layer 10 using a laser cutter, ultimately obtaining a final patch for sportswear.

A better understanding of the present invention, regarding the patch for sportswear and the method of producing the same, may be obtained via the following example, which is merely set forth to illustrate the present invention, and those skilled in the art will appreciate that various changes and modifications are possible, without departing from the scope and spirit of the invention as disclosed in the accompanying claims.

EXAMPLE

A white dyed polyester fabric having 210 T (denier) was placed on a work table, and was then coated with a polyurethane base solution comprising 50 g of a polyurethane resin, 40 g of MEK and 10 g of cyclohexane, thus forming a colorless polyurethane base coating layer. On the formed polyurethane base coating layer, a polyurethane-mixed coating solution comprising 80 g of the polyurethane base solution and 20 g of a white pigment was sequentially applied three times in the same manner, thus forming a first polyurethane-mixed coating layer, a second polyurethane-mixed coating layer and a third polyurethane-mixed coating layer, thereby manufacturing a substrate layer.

Separately from the substrate layer, a hot-melt adhesive sheet layer having a release sheet, i.e. a double-sided adhesive sheet, having a thickness of 100 μm, was placed on a work table, and was then coated with a primer coating solution comprising 50 g of nitrocellulose and 50 g of a polyurethane resin, thus forming a first primer coating layer. On the first primer coating layer, a mixture solution comprising 25 g of nitrocellulose, 5 g of calcium carbonate, 20 g of a polyurethane resin, 40 g of MEK and 10 g of cyclohexane was sequentially applied two times, thus forming first and second barrier coating layers. Thereafter, the same primer coating solution as in the first primer coating layer was applied on the second barrier coating layer, thus forming a second primer coating layer, thereby manufacturing a shielding layer.

Thereafter, a pattern sheet having a half-moon shaped pattern was positioned on the polyester fabric layer of the substrate layer and was then subjected to a sublimation transfer process through pressing using a red dispersion dye at 200° C. for 25 sec, thus forming a half-moon shaped red pattern on the surface of the polyester fabric layer.

To laminate the substrate layer and the shielding layer, a double-sided adhesive layer, having a thickness of 40 μm and made of the same material as in the hot-melt adhesive sheet layer of the shielding layer, was positioned on the third polyurethane-mixed coating layer of the substrate layer, and the polyester fabric layer of the substrate layer was disposed to face downwards. Subsequently, the second primer coating layer of the shielding layer, which was prepared separately, was positioned on the double-sided adhesive layer and pressed at 130° C. for 3 sec using a roller, thus bonding the substrate layer and the shielding layer to each other, thereby obtaining an integrated laminate. Thereafter, the laminate was cut along the pattern transferred onto the polyester fabric layer of the substrate layer using a laser cutter, ultimately completing a final patch for sportswear.

The half-moon shaped patch thus obtained was positioned on a pre-sewed blue rugby team uniform, and was then subjected to embroidery processing using an embroidery sewing machine, thus manufacturing a rugby team uniform having a half-moon shaped red patch fixed thereto.

This team uniform was worn for three months, after which the half-moon shaped patch showed a clear red color, and the blue color of the rugby team uniform did not migrate onto the half-moon shaped patch, and discoloration or migration did not occur even after washing 50 times. Furthermore, the half-moon shaped patch was not stripped from the rugby team uniform but was fixed well to the original position.

As described hereinbefore, the present invention provides a patch for sportswear, which is configured such that a special shielding layer is provided between a sportswear product and a substrate layer having a predetermined pattern, and thus no migration occurs even after the lapse of a long period of time. Furthermore, since the patch can be directly fixed onto a finished sportswear product, simple fixing is possible through a sewing process such as embroidery processing in response to orders, and thus there is no burden related to managing inventory, and efficient production is realized.

Moreover, the patch according to the present invention cannot be stripped even upon washing, thus exhibiting high durability, and environmental hormones and other harmful materials are not generated thanks to the obviation of a polyvinyl chloride (PVC) resin and the like, thus enabling the environmentally friendly production of the patch for sportswear.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A patch for sportswear, comprising:

a substrate layer, including:

a polyester fabric layer having a pattern, a polyurethane base coating layer adhered to the polyester fabric layer, a first polyurethane-mixed coating layer adhered to the polyurethane base coating layer and formed of a mixture solution comprising a polyurethane base solution and a white pigment, a second polyurethane-mixed coating layer adhered to the first polyurethane-mixed coating layer, and a third polyurethane-mixed coating layer adhered to the second polyurethane-mixed coating layer;

an anti-migration shielding layer, including:

an adhesive sheet layer, a first primer coating layer formed of a mixture solution comprising nitrocellulose and a polyurethane resin to increase adhesion between the adhesive sheet layer and a first barrier coating layer, the first barrier coating layer for preventing a color of a dye or a pigment from migration from sportswear, a second barrier coating layer adhered to the first barrier coating layer, and a second primer coating layer adhered to the second barrier coating layer; and a double-sided adhesive layer for bonding the third polyurethane-mixed coating layer of the substrate layer and the second primer coating layer of the anti-migration shielding layer to each other.

2. The patch of claim 1, wherein the polyurethane base coating layer of the substrate layer is formed by applying a polyurethane base solution comprising a polyurethane resin, methyl ethyl ketone, and cyclohexane, mixed at a weight ratio of 4~5:3~4:1~2.

3. The patch of claim 1, wherein the first and second barrier coating layers of the anti-migration shielding layer are each independently formed by applying a mixture solution comprising nitrocellulose, calcium carbonate, a polyurethane resin, methyl ethyl ketone, and cyclohexane, mixed at a weight ratio of 4~5:1:3~4:8:2, and the first and second primer coating layers comprise nitrocellulose and a polyurethane resin.

4. The patch of claim 1, wherein the first, second and third polyurethane-mixed coating layers of the substrate layer are formed by applying the mixture solution comprising the polyurethane base solution and the white pigment, wherein the polyurethane base solution comprises a polyurethane resin, methyl ethyl ketone, and cyclohexane, mixed at a weight ratio of 4~5:3~4:1~2, and wherein the polyurethane base solution and the white pigment are mixed at a weight ratio of 4:1.

5. A method of producing a patch for sportswear, comprising: forming a substrate layer, comprising a polyester fabric layer, a polyurethane base coating layer applied on the polyester fabric layer, a first polyurethane-mixed coating layer comprising a polyurethane base solution and a white pigment and applied on the polyurethane base coating layer, a second polyurethane-mixed coating layer applied on the first polyurethane-mixed coating layer, and a third polyurethane-mixed coating layer applied on the second polyurethane-mixed coating layer; forming an anti-migration shielding layer, comprising an adhesive sheet layer, a first primer coating layer for increasing adhesion between the adhesive sheet layer and a first barrier coating layer, the first barrier coating layer for preventing a color of a dye and a pigment from migration from sportswear, a second barrier coating layer applied on the first barrier coating layer, and a second primer coating layer applied on the second barrier coating layer; forming a pattern, by placing a pattern sheet on the polyester fabric layer of the substrate layer and performing sublimation transfer through pressing at 180 to 210° C. for 20 to 35 sec, thus transferring the pattern; laminating the substrate layer and the anti-migration shielding layer, by positioning a double-sided adhesive layer on the third polyurethane-mixed coating layer of the substrate layer, disposing the polyester fabric layer of the substrate layer to face downwards, positioning the second primer coating layer of the anti-migration shielding layer on the double-sided adhesive layer, and performing roller pressing at 120 to 155° C. for 3 to 5 sec, thus bonding the substrate layer and the anti-migration shielding layer to each other to form a laminate; and cutting the laminate comprising the substrate layer and the anti-migration shielding layer along the pattern of the polyester fabric layer of the substrate layer using a laser cutter, thereby forming a patch.

6. The method of claim 5, wherein in the forming the anti-migration shielding layer, the first and second barrier coating layers are each independently formed by applying a mixture solution comprising nitrocellulose, calcium carbonate, a polyurethane resin, methyl ethyl ketone, and cyclohexane, mixed at a weight ratio of 4~5:1:3~4:8:2, and the first and second primer coating layers comprise nitrocellulose and a polyurethane resin.

* * * * *